United States Patent [19]

Mitzel et al.

[11] 4,324,394

[45] Apr. 13, 1982

[54] DEVICE FOR SEPARATING RECORD CARRYING ITEMS

[75] Inventors: Wilhelm Mitzel, Neu-Keferloh; Herbert Bernardi, Haag, both of Fed. Rep. of Germany

[73] Assignee: G A O Gesellschaft für Automation and Organisation mbH, Fed. Rep. of Germany

[21] Appl. No.: 115,074

[22] Filed: Jan. 24, 1980

Related U.S. Application Data

[63] Continuation-in-part of Ser. No. 867,011, Jan. 5, 1978, and a continuation-in-part of Ser. No. 25,196, Mar. 29, 1979.

[30] Foreign Application Priority Data

Jul. 1, 1977 [DE] Fed. Rep. of Germany ..... 2729830
Mar. 4, 1978 [DE] Fed. Rep. of Germany ..... 2814306

[51] Int. Cl.[3] ..... B65H 3/14

[52] U.S. Cl. ..... 271/5; 271/98; 271/104; 271/195

[58] Field of Search ..... 271/94, 97, 98, 104, 271/122, 195, 5

[56] References Cited

U.S. PATENT DOCUMENTS

| | | | |
|---|---|---|---|
| 3,099,442 | 7/1963 | Wendricks | 271/97 |
| 3,318,640 | 5/1967 | Coville | 271/195 X |
| 3,645,526 | 2/1972 | Holecek et al. . | |
| 3,747,922 | 7/1973 | Groeber | 271/195 |
| 3,976,291 | 8/1976 | Bernardi | 271/104 X |

*Primary Examiner*—Richard A. Schacher
*Attorney, Agent, or Firm*—McGlew and Tuttle

[57] ABSTRACT

A feeder device for transferring a stack of paper sheets, such as bank notes, from a stack feeder device to a sheet receiving device includes an air conducting plate mounted between the stack feeder device and the receiving device. The plate has a plurality of bores extending therethrough at spaced intervals. Fluid pressure means are connected to the bores for discharging a stream of pressurized fluid along a feed path in the direction of the sheet receiving device and producing a low pressure along a surface of the plate adjacent the feed path. The bores are oriented to diverge toward opposite sides of the feed path.

11 Claims, 6 Drawing Figures

DEVICE FOR SEPARATING RECORD CARRYING ITEMS

CROSS-REFERENCE TO RELATED APPLICATION

This application is a continuation-in-part of copending patent application Serial No. 867,011 filed Jan. 5, 1978 and Ser. No. 025,196 filed Mar. 29, 1979.

FIELD AND INVENTION

This invention relates, in general, to a device for separating a stack of record carrying items, such as paper sheets, bank notes, documents or the like and, more particularly, to a feeder device for transferring a stack of paper sheets such as bank notes, from a stack feeder device to a sheet receiving device.

A separating device is disclosed in German published patent application No. (D7-OS) 2454082, in which a stack of record carrying items such as bills to be separated are fed to a separation gap by means of a feeder designed as a feed suction cylinder, and positioned with their leading edge in front of a separating suction cylinder. Then, by means of the separating suction cylinder, the respective foremost record carrying item is withdrawn from the stack. The items which are not to be separated are held back by a retainer cylinder that also is designed as a suction drum. To support the feed motion of the items, a jarring table is provided for supporting the stack at the lower edge thereof.

While the prior art separating device operates well in processing items of equal size, it has the disadvantage that a separation of differently sized items can be obtained only after repositioning the feed cylinder for every specific case. The prior art device has also proved to be unsatisfactory for separating ragged items having a contaminated or stick surface.

SUMMARY OF THE INVENTION

The invention is directed to a feeder of such design that the record carrying items can reliably be fed to the separating device, irrespective of their size, consistency, and surface contamination.

It is an object of the invention to provide a feeder device for transferring a stack of paper sheets, such as bank notes or the like, from a stack feeder device to a sheet receiving device. The inventive feeder device includes a plate means mounted adjacent to the receiving device and through the feeder device for conveying the stack through a feed path. The plate has a plurality of bores extending therethrough at intervals along the length and width thereof, and each of the bores extends obliquely of the feed path in the direction of the sheet-receiving device. Fluid pressure means connected to the bores for discharging a stream of pressurized fluid along the feed path in the direction of the sheet receiving device and for producing a low pressure along a surface of the plate means adjacent the feed path is provided. At least some of the apertures that are disposed at spaced intervals along the width of the plate means are oriented to diverge to opposite sides of the feed path. According to a feature of a further embodiment of the invention the plate means includes a surface portion underlying the feed path which is bevelled away from the feed path. In another embodiment of the invention, a support wall connected to the plate means extends alongside the plate means at a spaced interval adjacent the bevelled surface portion.

In accordance with a further embodiment of the invention, the plate means includes a plurality of plates and each of the plates extends longitudinally between the feeder device and the receiving device in parallel with each of the other plates.

In still another embodiment of the invention the plate means is provided with a bevelled portion which includes a plurality of the bores extending obliquely towards the support wall. The plate means can, according to another embodiment of the invention, include a second surface portion underlying the feed path which is bevelled away from the feed path, preferably at a location opposite the first-mentioned surface portion.

In accordance with even still another embodiment of the invention, the support wall includes a plurality of bores extending therethrough in communication with the fluid pressure means for delivering pressurized fluid laterally of the plate means. The support wall bores preferably include a discharge boss portion extending in parallel to the bevelled surface portion.

The feeder device, according to the invention, has the great advantage of insuring the treatment of items of variable size without adjustment. A further advantage of the invention is that even particularly ragged and worn-down items can satisfactorily be separated. The underlying reason for this is that the individual items to be separated are singled out and advanced while being engaged over their entire surface area.

In an advantageous embodiment of the invention, where the air conducting plate is in a horizontal position, an additional air blast plate may be disposed laterally thereof, permitting air flow from the side between the stack to be taken apart and the respective lowermost item. Due to the reduced friction thereby obtained, the feed motion in the direction of the separation gap is further facilitated.

In accordance with another advantageous embodiment of the invention, the outer edge of the air conducting plate may be bevelled, which additionally facilitates the sideward blowing of air and, at the same time, makes the record carrying item stiff to the effect that it does neither bulge nor bend in during the feed.

The various features of novelty which characterize the invention are pointed out with particularly in the claims annexed to and forming a part of this disclosure. For a better understanding of the invention, its operating advantages and specific objects attained by its uses, reference is made to the accompanying drawings and descriptive matter in which preferred embodiments of the invention are illustrated.

A further object of the invention is to provide a feeder device which is simple in design, rugged in construction and economical to manufacture.

DETAILED DESCRIPTION OF THE PREFERRED EMBODIMENTS

Figure 1:
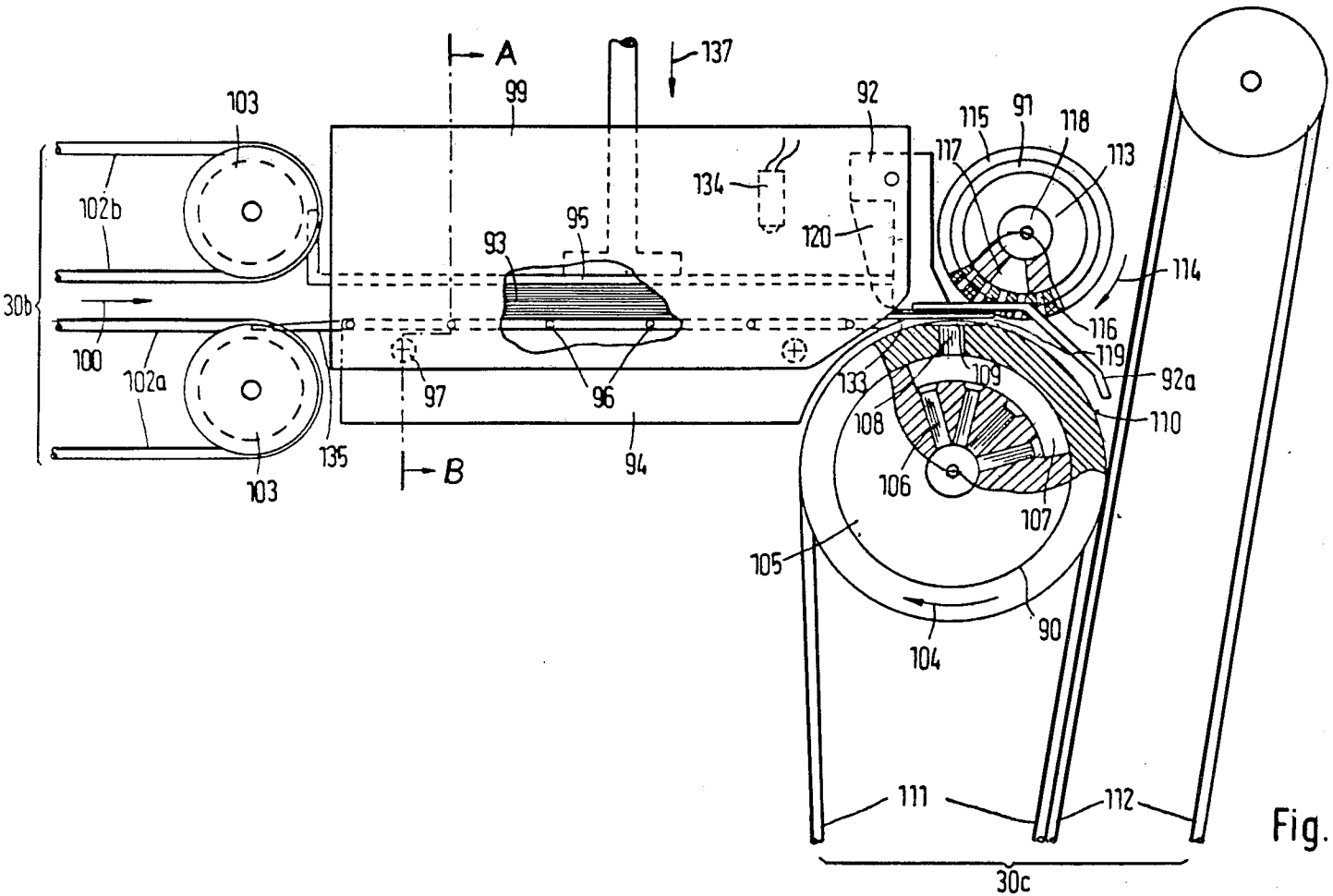
FIG. 1 is a side elevational view of a separating device, partly in section, according to the invention.

Referring to the drawings in particular, the invention embodied therein in FIG. 1 comprises a feeder device.

FIG. 1 is a general view of a separating device employed, for example, as a module integrated in a system for sorting bills. The device substantially comprises a separation cylinder 90, a retaining cylinder 91 with a retaining rake 92, an air conducting plate 94 for supporting a stack 93 of thin sheets of record carrying items, such as bank notes or bills, and feeding the individual bills to the separation cylinder 90, a pressure plate 95 gives the stack 93 a uniform shape, and an air blast plate 99 attached laterally to air conducting plate 94 and provided with a plurality of air blast bores 96. The stacks to be taken apart are supplied in the direction of arrow 100 by means of the bill conveying section **30*b* including belts 102*a* and 102*b* and rollers 103**.

According to FIG. 1, the separating cylinder 90 rotates in the direction of arrow 104 on a concentric fixed gate cylinder 105. Cylinder 105 is provided with a plurality of channels 106 opening into a recessed clearance 107. This clearance communicates through channels 106 with a vacuum pump (now shown). A row of suction holes 108 is provided in separating cylinder 90, more particularly, in a rubber strip 109 which is embedded in cylinder 90. Rubber strip 109, which has a surface flush with the cylinder surface, serves to increase the friction while the separated bill is exposed to suction.

Figure 2:
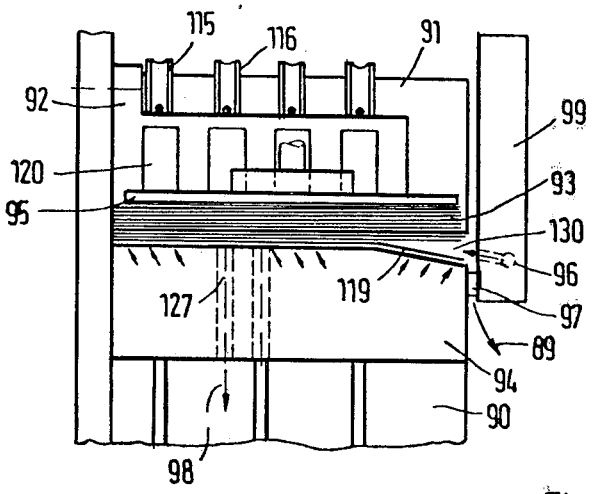
FIG. 2 is a sectional view of the device, taken along the line A-B of FIG. 1.

The recessed clearance 107 of gate cylinder 105 permits the vacuum to be effective through holes 108. The recessed clearance 107 is disposed and dimensioned so that each lowermost bill 119, to be separated is positively fixed by suction along its leading edge but can be released again after approximately a quarter turn of separating cylinder 90 and transferred to belts 111, 112 of the conveying section **30*c* provided at the delivery side of the separator. To eliminate double withdrawals of bills from the stack, a retaining cylinder 91 rotating on a fixed gate cylinder 113 is provided above segregating cylinder 90, as shown in FIG. 1. Retaining cylinder 91 rotates in the direction of arrow 114, that is, opposite to the rotation of separating cylinder 90. Retaining cylinder 91 is designed as a suction cylinder and carries suction rings 115, which are disposed thereon side by side. As shown in FIG. 2, the suction rings 115 are provided with suction apertures 116 uniformly distributed on their circumferential surface. Since the fixed gate cylinder 113 has only one opening 117 which communicates through an axial cavity 118 with a vacuum pump (not shown), any bill already present in separation gap 133, formed between retaining rake 92 and separating cylinder 90, but not to be separated at that time is held back by the suction effect of retaining cylinder rotating opposite to the direction of separation, and is intermittently pushed back into stack 93. Retaining rake 92 insures that any time only the lowermost bills of stack 93 pass through separation gap 133 to separating cylinder 90, and keeps the other bills of stack 93 away from retaining cylinder 91**.

As mentioned above, retaining cylinder 91 performs the important function of performing double withdrawals by returning bills not to be separated back into stack 93. However, in instances where horizontally placed stacks are treated, and if the necessity arises to treat particularly ragged bills, a return of bills not to be separated may be successful only if the friction acting on the bills to be returned and resulting from the weight of the stack as well as the coefficient of friction between the bills, is reduced to a minimum by a corresponding loosening up of the stack structure. The return of the bills not to be separated may additionally be facilitated by stiffening the respective bills.

Another criterion for the fast and reliable separation is the prevention of incorrect withdrawals of bills from the stack. For this purpose, it is necessary to guide each bill to be separated into a definite separating position and, in addition, to relieve the bill from the load of the stack to such an extent that it can easily be withdrawn by separating cylinder 90 from the underside of stack 93.

Figure 3:
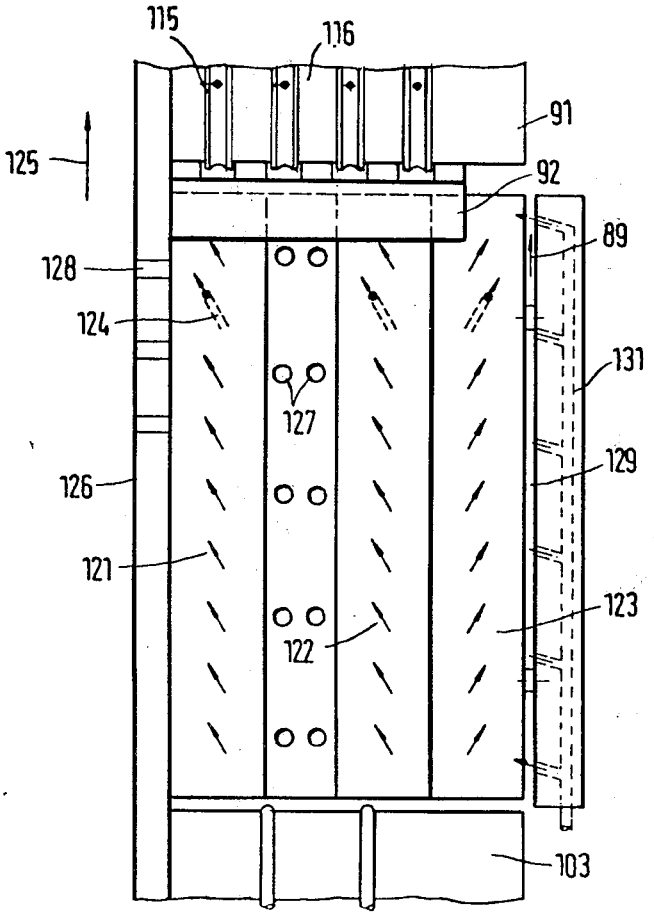
FIG. 3 is a top plan view of the air conducting plate of the device of FIG. 1.

These conditions are achieved by the provision of two substantial elements in the separating device shown in FIGS. 1, 2 and 3. The first element is an air conducting plate 94 which supports the bill stack 93 and insures that the lowermost bills become stiffened and displaced into a definite separating position as explained hereinafter. The second element is an air blast plate 99 which loosens the stack of bills and, by means of a lateral air blast and, along with the air conducting plate 94, relieves the lowermost bill 119 to be separated from the load of the overlying stack.

The construction and function of air conducting plate 94 will now be explained in detail.

As shown in the figures, air conducting plate 94 includes three air conducting zones 12, 122, 123 extending in parallel in the longitudinal direction of the plate. All these zones are uniformly provided with air blast bores 124 which produce a defined air cushion above each of the zones in accordance with the known principle of hydrodynamic paradoxon. To obtain this effect, compressed air from within the plate is blown through the bores, which extend obliquely upwardly relative to the bill feed direction (arrow 125) so that the air passes tangentially between air conducting plate 94 and the bills placed thereon. Since the air stream leaving a bore expends to all sides, its velocity at the bore exit is substantially higher than in the vicinity thereof. Consequently, a low pressure area is produced above the bore, causing the bill to be pulled toward air conducting plate 94. As the bill approaches the bore, the pressure above and bore rises and the bill is repelled. Under stationary conditions, a state of equilibrium establishes in which the lowermost bill of stack 93 hovers at a very small distance above the surface of the plate. The tangentially emerging component of the air flow now additionally acts on the lowermost bill of the stack as a translatory force in the direction corresponding to that in which the air flows out from bores 124.

According to FIG. 3, two air conducting zones 121, 122 of plate 94 extending closer to a mounting wall 126 have their bores 124 oriented identically. Here, the air blast bores produce a feed force component in the direction of separating cylinder 90 or retaining cylinder 91, as well as a feed force component in the direction of mounting wall 126 since they also extend obliquely toward wall 126 thereby diverging from the general feed direction indicated by arrow 125.

In contrast, bores 124 of third air conducting zone 123 of plate 94 extend obliquely toward the air blast plate 99 so that they produce a feed force component in the direction of separating cylinder 90 and a feed force component away from mounting wall 126, toward air blast plate 99.

Due to the divergent arrangement of bores 124, the lowermost bills adjacent air conducting plate 94 are so forceably stretched and flattened, and their stiffness is thereby increased. To avoid irregularities in the stretching due to air stagnation, venting bores 127 are provided between air conducting zones 121 and 122 to permit the air which may accumulate there to escape in the direction of arrow 98.

Similarly, bores 128 are provided in mounting wall 126 and a venting zone 129 is provided at air blast plate 99 to prevent the longitudinal edges of the lowermost bills adjacent air conducting plate 94 from "fluttering" or bulging under the effect of accumulating air. Aside from the different air flow direction, the third air conducting zone 123 of plate 94 is distinguished from the other two zones 121, 122 in that the surface of its longitudinal edge portion opposite mounting wall 126 is bevelled, and thus slopes downwardly away from stack 93 as shown in FIG. 2. The lowermost bill 119, closest to air conducting plate 94, is thereby drawn from the stack even further by the low pressure area produced, as explained above, along its longitudinal edge. The air blast is then intentionally directed into the wedge-shaped interspace 130 thus formed, so that lowermost bill 119 is relieved from the load of the overlying stack 93.

Besides stiffening the bills over their entire surface, air conducting plate 94 has still another function, namely to use different feed force components to bring the lowermost bills of the stack into a definite separating position. The separating position is attained as soon as on the one hand, the longitudinal edge of the respective bill abuts against the vertically extending mounting wall 126, and on the other hand, the leading edge of the bill, considered in the feed direction (arrow 125), reaches a position in front of retaining cylinder 91 and above suction holes 108 of separating cylinder 90 (FIG. 1), just before the bill is fixed to cylinder 90 by suction and withdrawn from stack 93.

As shown in the sectional view of FIG. 2, air blast plate 99 is laterally secured to air conducting plate 94 by means of two supports 97. It is provided with a row of air blast bores 96 which are arranged horizontally side by side and at the level of the surface of air conducting plate 94, parallel to the bevelled portion of the longitudinal edge thereof. Also, as shown in FIG. 3, air blast bores 96 are included, slightly obliquely, in the feed direction (arrow 125) to support the general advancing effect of air conducting plate 94. Air blast bores 96 are connected through a common pipe 131 to a timed source of compressed air. The timing is synchronized with the separation, that is, the air from the side is blown into the wedge-like space 130 only during the period of separating the individual bill 119 from the overlying stack 93, to produce a second air cushion in that space. This makes it possible to withdraw the lowermost bill 119 from stack 93, by means of separating cylinder 90, under conditions of a very low friction.

As noted above, to avoid air accumulation at the bevelled portion of air conducting plate 94, a venting zone 129 is provided below air blast bores 96 so that the air may escape in the direction of arrow 89.

The delivery of a stack into the separating device insured by a rake 135 (FIG. 1) projecting into the lower conveyor roller 103, and by pressure plate 95 which engages upper conveyor roller 103 in the manner of a comb. Stack 93 is advanced to retaining rake 92 or retaining cylinder 91 partly by its own inertia and partly due to the effect of the air cushion produced by air conducting plate 95. Upon introducing the bill stack, pressure plate 95 is somewhat lowered in the direction of arrow 137, thereby giving the stack a definite shape under slight uniform pressure which is maintained during the entire separating operation.

During the introduction of the stack, the bills located at the stack bottom are pushed, due to the particular characteristics of air conducting plate 94, along the vertically extending mounting wall 126 into separation gap 133, until their leading edges abut against suction rings 115 of retaining cylinder 91. In the meantime, due to the air cushion produced by the air conducting plate and the suction and advancing effects associated therewith, the stack now occupies a standby position within the separating device. The longitudinal edge portion of the lowermost bill of the stack, which extends along the bevelled portion 123 of air conducting plate 94, is deflected downwardly. The leading edge of bill 119 in the feed direction resposes with its underside on separating cylinder 90. As soon as holes 108 of separating cylinder 90 reach the recessed clearance 107 of gate cylinder 105, the leading edge of the lowermost bill 119 of the stack becomes attached by suction. About at the same instant, the horizontal row of air blast bores 96 in air blast plate 99 is connected to a compressed air source so that additional air is blown along the entire stack between the bill to be separated and the overlying stack. The bill thus relieved from load of the stack by the two air cushions can then easily be withdrawn from the stack. As soon as holes 108 have passed beyond the recessed clear zone 107 of gate cylinder 105, they are no longer under vacuum. The leading edge of the bill disengages from the separating cylinder and is no longer prevented from being transferred to a following conveyor section 30*c* comprising the belts 111, 112. With the bill completely withdrawn from the stack, the air flow blown through air blast bores 96 of plate 99 is interrupted. This assures that the next bill to be separated can again, and without hindrance, be deflected along its longitudinal edge portion under the suction pressure applied to the bevelled portion 123 of air conducting plate 94.

An extension 92*a* of retaining rake 92 guides the separated bills and introduces their leading edges into the following conveyor section 30*c*.

The remaining bills of the stack are held back by retaining cylinder 91 and pushed back to the stack. The effective suction range in retaining cylinder 91 is limited to the width of opening 117 of gate cylinder 113.

Should air conducting plate 94 be mounted vertically instead of horizontally, that is, with the stack placed on its edges and the separation not complicated by the load of the overlying stack, the additional, laterally mounted air blast plate 99 may be omitted.

Figure 4:
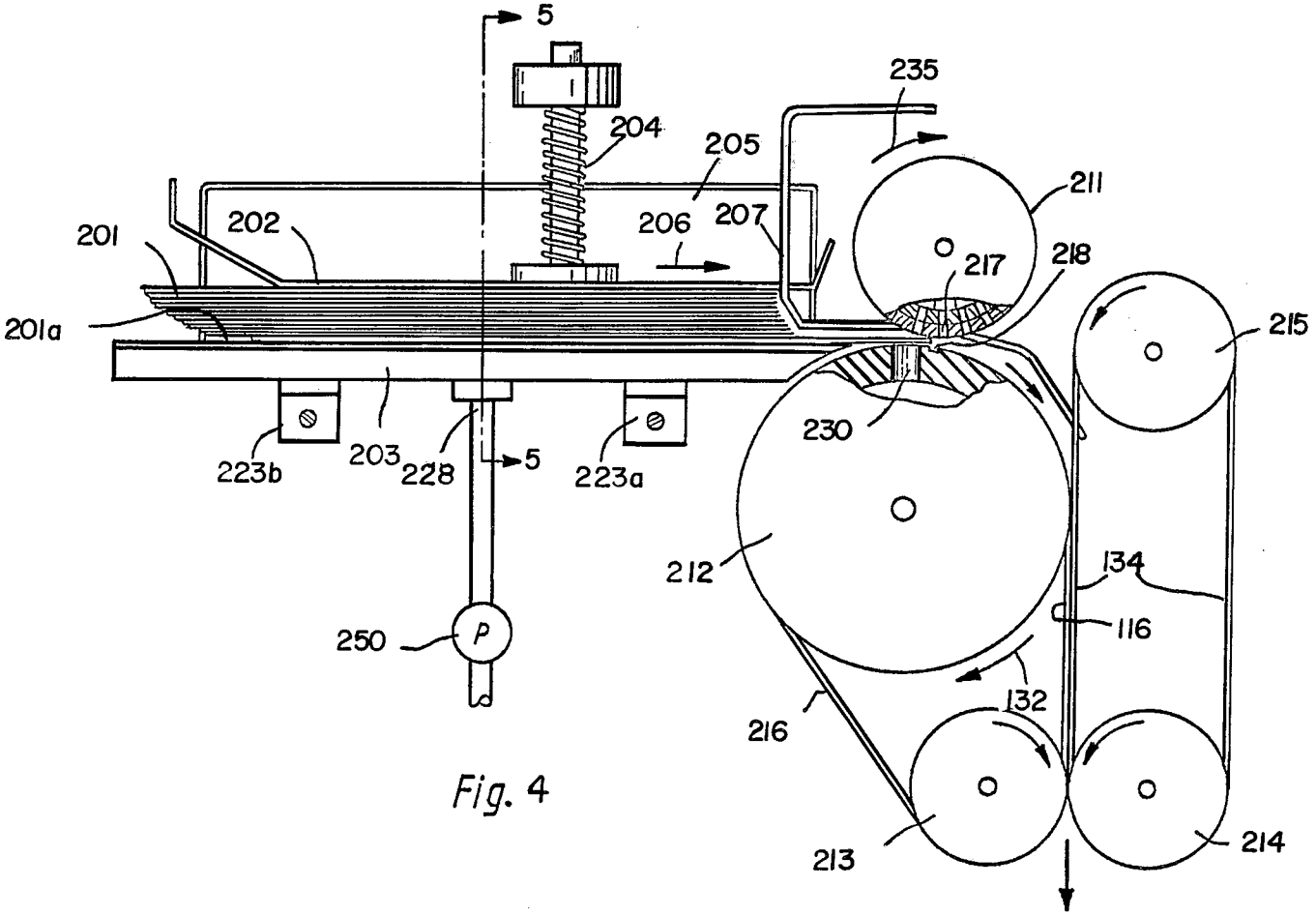
FIG. 4 is a side elevation view, partly in section, of an alternate embodiment of a separating device according to the invention.
Figure 6:
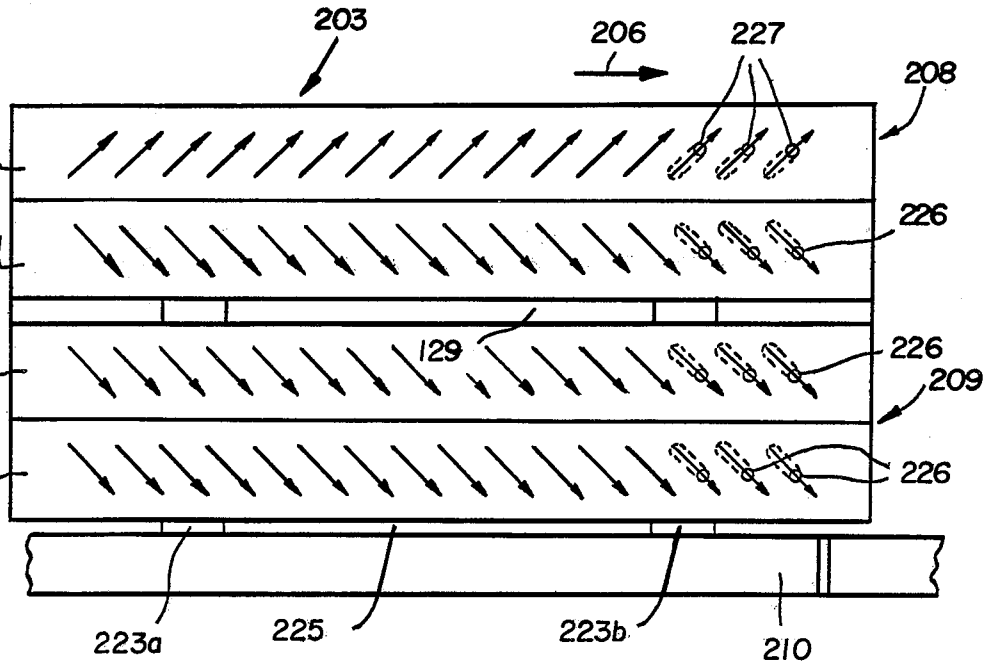
FIG. 6 is a top view of the device of FIG. 5.
Figure 5:
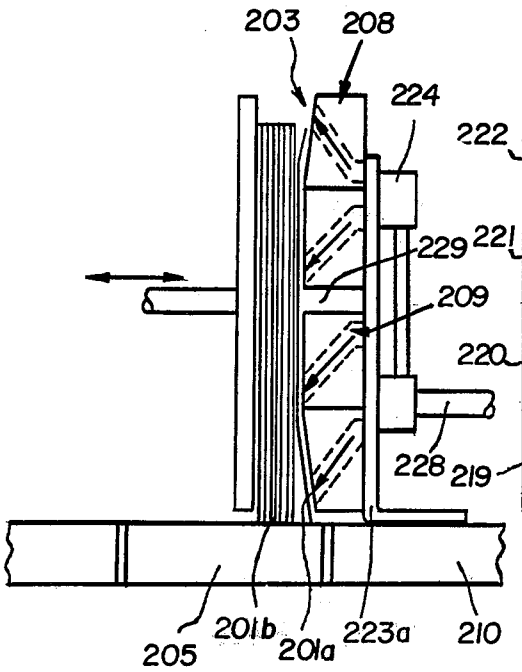
FIG. 5 is a sectional view of the device of FIG. 4 taken along the line 5—5.

An alternate embodiment of the invention is illustrated in FIGS. 4 through 6.

A stack 101, comprising bank notes or the like, is pressed by means of the pressure plate 102 through the action of the spring 10A, against an abutting plate 103, which is embodied as an air-conducting plate, in such a manner that the bank notes are retained in the form of a packet and are not upset.

The lower edge of the stack 101 rests on jarring means 105, which may shake and loosen the stack and, on the whole, gives it a feed force component in the direction of feed (as indicated by arrow 106).

As shown in FIG. 4, the bank notes strike against a retaining rake 207. The rake 207 facilitates separation from the retaining drum 211 and ensures that, in all cases, only the lowermost 201*a*, resting directly on the air-conducting plate 203 can be moved towards a feed slot 218, with the aid of the air conducting plate 203. A feed drum or feeding suction drum 212 rotates in the direction of arrow 232 and includes only a single row of suction ports 230, which always communicate with a vacuum pump or means (not shown) when the feed drum 212 assumes the position shown in FIG. 4.

After the rotation of the feed drum 212 through approximately 100°, the vacuum intake air is again interrupted after the leading edge of the bank note has been securely introduced into the transport system by means of the belts 216, 234 and the pulleys 213, 214, 215. Belt 216 around drum 212 and pulley 213 and belt 234 around pulleys 214 and 215 cooperate to remove a note from the stack 201.

The retaining drum 211 is provied in order to avoid two or more of the bank notes which are conveyed to the retaining rake 207 from being withdrawn. The retaining drum 211 rotates against the direction of the feed drum 212 in the direction of the arrow 235. The retaining drum 211 also communicates with a vacuum pump (not shown) via the suction ports 217, distributed along the whole of its circumference, with the result that the bank notes which have not to be fed are withdrawn and pushed back into the stack due to the rotary motion of drum 211. Drums 212 and 211 comprise draw-off means for the feed apparatus.

The continuous withdrawal of the lowermost bank notes into the feed slot 218 is facilitated, as mentioned heretofore, by means of the air conducting plate 203 which at the same time also serves as an abutting plate. The construction and function of this air-conducting plate will now be explained with the aid of FIGS. 5 and 6.

As shown in FIGS. 5 and 6 in a sectional and in a top view, the air conducting plate consists of two elements 208 and 209 which are both mounted a fixed but adjustable distance apart on a building block member 210 by means of mounting supports 223*a*, 223*b*. Jarring means 205 forms a part of the building block member. The elements of the air conducting plate communicate with a compressor means or pump 250 (FIG. 1) via a feed pipe 228 and a feed system 224. As can be seen in FIG. 6 in particular, each of the two elements 208 and 209 have two air-conducting areas 219, 220 and 221, 222 running parallel in the longitudinal direction of the plate. All areas are provided in like manner with air blast passages and holes 226, 227 inclined in the direction of transport (direction of arrow 206), in which case, however, the holes 226 point in the direction of the building plate 210 and the holes 227 are turned away from the building plate 210.

Since the air stream spreads in all directions after emerging from the hole 226, 227, its speed at the opening of the hole is considerably higher than in the vicinity of the hole. As a result, a partial vacuum is created a certain distance above the hole, and this partial vacuum draws the bank note toward the air conducting plate 203. It is not until the bank note threatens to close the hole openings that the pressure above the hole increases so that the bank note is pushed away from the plate surface again. In the stationary case, a state of equilibrium is brought about in which the lowermost bank note 201*a* in the stack 201 hovers at a very low altitude above the air-conducting plate 203 (hydrodynamic paradoxon). The tangentially emerging air stream now causes an additional feed force whose direction corresponds to the respective direction of discharge of the passages with holes 226.

As shown in FIG. 6, the first three air-conducting areas 219, 220, 221 of the air-conducting plate 203, as viewed from the building block 210, are identical with respect to the arrangement of their passages and holes 226. Here the air blast holes generate a feed force component in the direction of the building block 210, or towards the jarring table 205, and a feed force component in the direction of transport 306.

The holes 227 of the fourth air conducting area 222 of the air-conducting plate 203 are also inclined in the direction of transport 206, but unlike the holes 226 they are, however, inclined away from the building block 210. Along with the feed force component directed toward the direction of transport 206, a second feed force component, which is directed away from the building block 210, is produced in this manner. Through the divergent arrangement of the holes 226, 227, the respective lowermost of the bank notes 201*a* lying on the air-conducting plate 203, are stretched and forced into a plane position. To avoid irregularities in the plane position due to a stagnation of air, a vent slot 229 is provided between the air conducting areas 219, 220 and 221, 222 to permit any air having accumulated there to flow off.

Similarly, accumulated air can flow off through the slot 225 between the air-conducting plate 3 and the building block 210 or the jarring table 205.

It can be ensured by means of these air venting measures that the lowermost bank notes 201*a* lying on the air-conducting plate 203 will not "flutter" or turn up as a result of air accumulating there.

As can be seen in the cross-sectional view in FIG. 5, a further feature of the air-conducting plate is to be seen in the fact that the respective outermost air-conducting surface or areas 219, 222 are bevelled as against the adjacent surfaces or areas. In this manner, it can be achieved on the one hand that each bank note 201*a* to be fed, which is adapted to the characteristic curvature of the air-conducting plate, is additionally stiffened due to the curvature. On the other hand, the bank note 201*a* at its upper or lower portions or areas is separated at the same time from the rest of the stack 201 with the result that a large portion of the friction produced with the following bank note 201*b*, is eliminated. End areas 219 and 222 may also be curved or the whole of plate 203 may be convex or generally curved as seen in the direction of FIG. 5.

Finally, it is noted that the holes 226 of the air-conducting areas 219, 220, 221 produce a mutual feed force component in the direction of the building block 210 as against the holes 227 of the air conducting areas 222. In this manner, it can be ensured that the bank notes will not rise when being forced into the feed passage 218.

As can be seen in FIGS. 5, 6, the air-conducting plate 203 comprises two separate air-conducting elements 208, 209. This manner of embodying the air conducting plate 203 which could also be facilitated for instance by way of four individual elements, is particularly advantageous since in this manner, depending on necessity, the combination of various air-conducting areas is possible without making it necessary to keep separate air-conducting plates 203 for each possible combination in store. If the individual air-conducting elements 208, 209 (air-conducting areas 219, 220, 221, 222) are mounted a certain distance apart on supports 223*a* and 223*b*, it is possible without further resources to facilitate both a large extent of effective adaptation to the width of the bank notes to be fed and the automatic formation of vent slots 229.

While specific embodiments of the invention have been shown and described in detail to illustrate the application of the principles of the invention, it will be understood that the invention may be embodied otherwise without departing from such principles.

What is claimed is:

1. A feeder device for feeding sheets of a stack of paper sheets, such as bank notes, one at a time through a feed path from a stack feeder device to a sheet receiving device comprising: an air conducting plate having a surface for receiving the stack disposed along the feed path, said air conducting plate being mounted adjacent to and upstream of the receiving device and adjacent to the feeder device for conveying the stack through the feed path, said air conducting plate having a plurality of air air blast passages extending therethrough each of said passages having a hole in said surface at longitudinally and transversely aligned and spaced intervals along the length and width thereof, each of said passages extending obliquely of the feed path in the direction of the sheet receiving device, fluid pressure means connected to said passages for discharging a stream of pressurized fluid along the feed path in the direction of the sheet receiving device and producing a low pressure along said surface of said air conducting plate adjacent the feed path to pneumatically feed a sheet to the sheet receiving device and at least some of said passages of said holes aligned at the transversely spaced intervals along the width of said plate being divergent to opposite sides of the feed path, wherein said surface of said air conducting plate is divided into a plurality of air conducting areas, each of said air conducting areas including at least some air blast passages, and wherein each of said air conducting areas extends the length of said air conducting plate along said feed path with the orientation of each of said air blast passages in every one of said air conducting areas connected to longitudinally aligned holes in said air conduction area being parallel with each other, and said receiving device comprising a feeding suction drum rotatably mounted with its periphery adjacent the feed path and moving in the feed path direction and a retaining suction drum rotatably mounted with its periphery adjacent the feed path and moving in a direction opposite the feed path direction, adapted to retain sheets in the stack adjacent a sheet to be fed, with a feed slot defined between the peripheries of said feeding and retaining suction drums in the feed path.

2. A device according to claim 1, further including a building block member connected to said air conducting plate and adapted to support one edge of the stack, at least some of said air blast passages being oriented for channeling air in a direction having at least one component directed toward said building block member, the orientation of the air blast passages in at least one of said air conducting areas having a directional component directed away from said building block element, and the air blast passages of at least one other of said air conducting areas having a directional component directed toward said building block element.

3. A device according to claim 2, wherein a greater number of air blast passages overall include directional components directed towards said building block member than the number of air blast passages having directional components directed away from said building block member, whereby a sheet to be fed is moved along the feed path direction by air emitted from said air blast passages and simultaneously urged toward said building block element.

4. A device according to claim 1, wherein said air conducting areas comprising said air conducting plate have at least one vent area defined between two adjacent ones of said air conducting areas.

5. A device according to claim 1, wherein said air conducting plate is curved.

6. A device according to claim 5, wherein said air conducting plate is curved convexly as viewed along the feed path.

7. A device according to claim 1, wherein the outermost air conducting areas of said air conducting plate are curved.

8. A device according to claim 1, wherein the outermost air conducting areas of the said air conducting plate are bevelled in the direction away from a plane including the feed path.

9. A device according to claim 1, wherein each of said air conducting areas extends along the feed path and is separate.

10. A device according to claim 9, including at least two air conducting elements, each of said air conducting elements including at least one of said air conducting areas, each of said air conducting elements being connected to said building block with a spacing therebetween defining a vent slot extending along the feed path.

11. A device according to claim 10, including mounting elements connected between said building block element and said air conducting elements for fixing the spacing between said air conducting elements and the width of said vent slot at various values.

* * * * *